United States Patent [19]

Burke et al.

[11] 3,939,602

[45] Feb. 24, 1976

[54] CIRCULAR AIR GLIDER

[75] Inventors: Harry E. Burke, Chicago; Burton C. Meyer, Downers Grove, both of Ill.

[73] Assignee: Marvin Glass & Associates, Chicago, Ill.

[22] Filed: May 27, 1975

[21] Appl. No.: 580,663

[52] U.S. Cl. ..... 46/74 D
[51] Int. Cl.[2] ..... A63H 27/00
[58] Field of Search ..... 46/74 R, 74 D

[56] References Cited

UNITED STATES PATENTS

| | | | |
|---|---|---|---|
| 3,742,643 | 7/1973 | Keith | 46/74 D |
| 3,765,122 | 10/1973 | English | 46/74 D |

*Primary Examiner*—Louis G. Mancene
*Assistant Examiner*—Robert F. Cutting
*Attorney, Agent, or Firm*—Coffee & Sweeney

[57] ABSTRACT

A hand propelled circular air glider or flying saucer type aerodynamic toy. The toy includes a solid upper disc portion and a concentric, substantially larger lower annular disc portion having an aperture therein approximately equal to the diameter of the upper disc portion. The upper disc portion and lower annular portion are disposed generally parallel and are connected together by a plurality of radially directed, generally trapezoidal, evenly spaced fins. A depending, short cylindrical flange circumscribes the outer perimeter of the lower annular portion to stabilize the flight of the toy as it precesses through a gaseous medium.

8 Claims, 4 Drawing Figures

CIRCULAR AIR GLIDER

BACKGROUND OF THE INVENTION

1. Field of the Invention

This invention relates to aerodynamic toys to be thrown through the air and, in particular, to an improved flying saucer type toy having greater stability during flight.

2. Description of the Prior Art

In the past, aerodynamic toys resembling flying saucers have become quite popular as throwable gliding toy implements. In the usual embodiment, the toy is made of a plastic material, or the like, in the shape of a saucer having a depending rim located around the lower outer marginal edge to facilitate gripping by the user. The rim curves downwardly from the saucer and has a configuration such that the implement, when viewed in elevation, approximates the shape of an air foil. Throwing is usually accomplished with a wrist snapping motion whereby momentum and a spinning motion is imparted to the toy to cause it to fly or glide through the air. Its appeal as a toy usually resides in the fact that it exhibits definite aerodynamic characteristics and can be made to do a number of various maneuvers depending upon the skill of the user.

SUMMARY OF THE INVENTION

An object of the present invention is to provide a new and improved flying saucer type aerodynamic toy or circular glider having improved flight characteristics.

The aerodynamic toy of the present invention includes an upper central disc portion which is connected in a transverse spaced relationship to a lower, larger annular disc portion by a plurality of generally perpendicular, equally spaced radial ribs. The disc portions are concentric and an aperture, approximately the same diameter as the upper disc portion, is provided in the center of the lower disc portion. A depending, cylindrical flange is provided around the outside perimeter of the lower disc portion to facilitate gripping by the hand of the user.

Other objects, features and advantages of the invention will be apparent from the following detailed description taken in connection with the accompanying drawings.

DESCRIPTION OF THE PREFERRED EMBODIMENT

Figure 1:
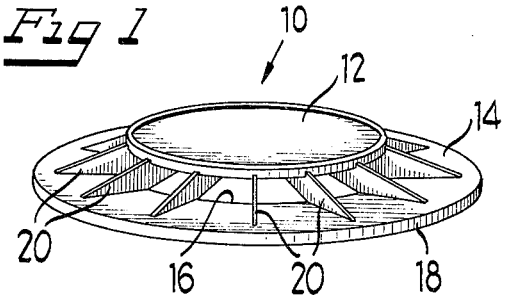
FIG. 1 is a perspective view of the aerodynamic toy of the present invention.
Figure 4:
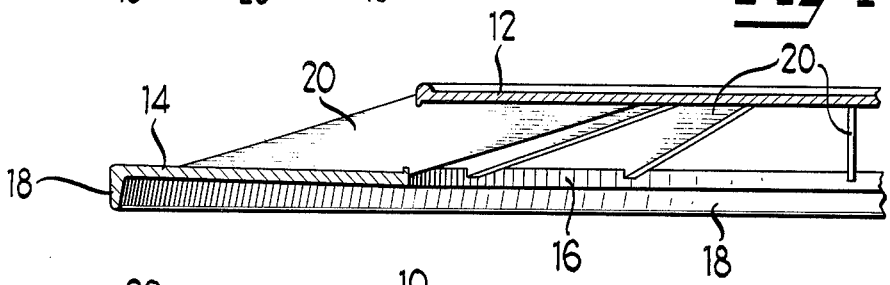
FIG. 4 is a fragmented, vertical section of the toy, taken generally along the line 4—4 of FIG. 2.
Figure 2:
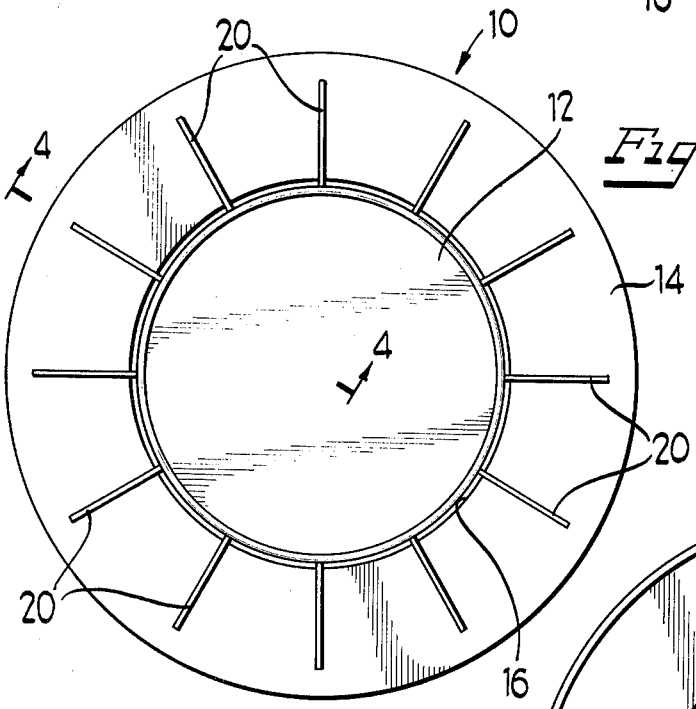
FIG. 2 is a top plan view, on an enlarged scale, of the aerodynamic toy of FIG. 1.
Figure 3:
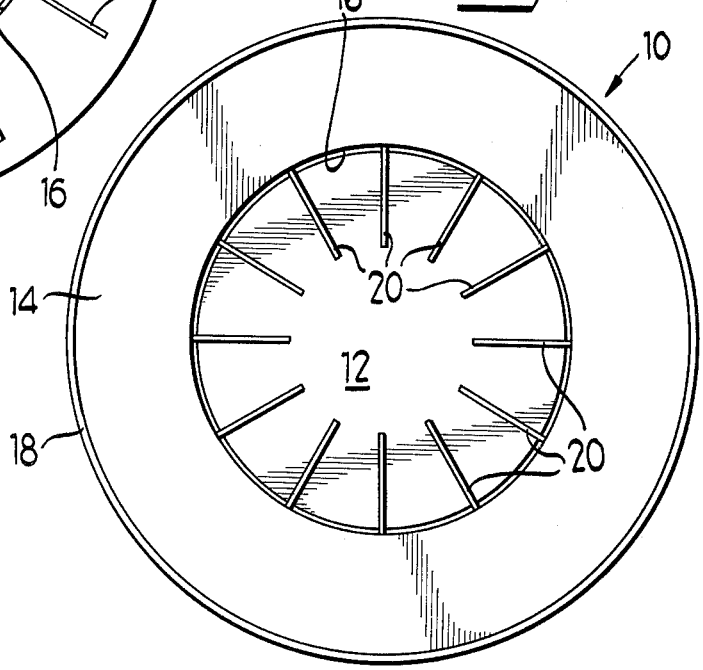
FIG. 3 is a bottom plan view, similar to FIG. 2, of the toy of the present invention.

Referring now to FIG. 1, there is shown a perspective view of the aerodynamic toy, generally designated 10, of the present invention. The toy 10 includes an upper central disc portion 12 and a concentric, substantially larger, lower disc or annular ring portion 14. The annular ring portion 14 includes an aperture 16 in the center thereof which is approximately equal in diameter to the diameter of the upper disc portion 12. A generally cylindrical, depending marginal flange 18 is provided about the perimeter of the annular ring portion 14 to facilitate gripping of the toy 10 by the hand of the user and also to assist in flight, as will be described in detail hereinafter.

A plurality of generally trapezoidal fins 20 interconnect the upper disc portion 12 and the lower annular ring portion 14 to maintain the relative portions in a parallel, spaced relationship. The fins 20 are radially directed and equally spaced around the circumference of the toy 10. Air passages thus are provided between the fins, between the spaced upper disc portion 12 and lower annular ring portion 14.

In practice, it has been found that when the toy is thrown in a spinning propulsion such that the discs 12 and 14 are approximately horizontal with respect to the ground, it displays definite aerodynamic properties and tends to "fly" or glide in the direction of propelled travel at the time it leaves the hand of the user and is sustained in very stable flight in a given direction throughout the flight. It is believed that the toy has improved flight characteristics because of the aerodynamic lift, for one thing, generated as the toy precesses along its course. The improved flight characteristics of the toy, i.e., stability and controlled flight, is believed to be due to a combined effect of the following aerodynamic principles. An aerodynamic lift is generated on the toy because of a lower air pressure on the top of the ring portion 14 relative to that on the bottom of the ring portion. This lower pressure on the top of the ring portion is believed to be generated by air passing across the top of the ring portion through the passageways between the ribs 20 and between the upper disc portion 12 and the lower ring portion 14.

In conventional flying saucer type toys, the arcuate or curved upper surface causes the air to travel a greater distance across the top of the object than the bottom of the object thus generating a lower pressure on the top to generate the lift. While this effect undoubtedly contributes to a portion of the lift exerted on the toy of the present invention, it is also believed that the ribs perform a function similar to that function performed by the vanes in an axial fan or blower. Mainly, the ribs cause air in the interior region thereof to rotate with the body and thus to be expelled radially by centrifugal forces. As the air is expelled between the ribs it passes over the top surface of the lower annular ring portion 14 at a relatively rapid rate thus causing a low pressure area above the lower ring portion whereby the lift is generated.

The depending peripheral flange 18 about the ring portion also creates air resistance to any diametric rotation of the toy during flight.

These improved flight characteristics, in particular the increased stability under high speed flight, is highly desirable since slight mistakes in the execution of a throw of known flying saucer type toys tend to be exaggerated in flight and thus drive the toy wildly off course.

The foregoing detailed description has been given for clearness of understanding only and no unnecessary limitations should be understood therefrom as some modifications will be obvious to those skilled in the art.

We claim:

1. An aerodynamic toy, comprising:

a generally circular upper disc portion;

a lower annular ring portion concentric with said upper disc portion, with a central aperture therethrough; and angularly spaced support means connecting said upper disc portion and said lower ring portion in a parallel, spaced relation providing air passage means through said aperture and the spaced support means and between the upper disc portion and lower annular ring portion, and whereby precession of the toy through the air will impart lift to the toy.

2. The aerodynamic toy of claim 1 wherein the central aperture in the lower annular ring portion is approximately equal to the diameter of the upper disc portion.

3. The aerodynamic toy of claim 1 wherein said lower annular ring portion includes a generally perpendicular, depending flange around the outer perimeter thereof.

4. The aerodynamic toy of claim 1 wherein said angularly spaced support means includes at least one generally radially directed fin.

5. The aerodynamic toy of claim 4 wherein the support means includes a plurality of equally spaced radially directed fins.

6. The aerodynamic toy of claim 5 wherein the fins are generally trapezoidal.

7. An aerodynamic toy, comprising:

a generally circular upper disc portion;

a lower annular ring portion concentric with said upper disc portion and having a diameter substantially larger than said upper disc portion;

a central circular aperture in said lower annular ring portion, having a diameter approximately equal to the diameter of said upper disc portion;

a generally perpendicular, depending flange about the periphery of said lower annular ring portion; and a plurality of equally spaced, radially directed fins connected between the upper disc portion and the lower disc portion to maintain said discs in a parallel, spaced relation providing air passage means through said aperture and the spaced support means and between the upper disc portion and lower annular ring portion, and whereby precession of the toy through the air will impart lift to the toy.

8. The aerodynamic toy of claim 7 wherein the fins are generally trapezoidal.

* * * * *